US007563122B2

(12) United States Patent
Goetze et al.

(10) Patent No.: US 7,563,122 B2
(45) Date of Patent: Jul. 21, 2009

(54) CONNECTOR SYSTEM FOR A WALL INSTALLATION

(75) Inventors: Andrea Goetze, Horn-Bad Meinberg (DE); Klaus-Dieter Endres, Maintal (DE); Klaus Steinmetz, Flörsheim/Main (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/002,590

(22) Filed: Dec. 18, 2007

(65) Prior Publication Data

US 2008/0166922 A1 Jul. 10, 2008

(30) Foreign Application Priority Data

Dec. 22, 2006 (DE) ..... 20 2006 019 402 U

(51) Int. Cl.
*H01R 13/62* (2006.01)

(52) U.S. Cl. ..... 439/372; 439/157

(58) Field of Classification Search ..... 439/372, 439/157, 159, 160
See application file for complete search history.

(56) References Cited

U.S. PATENT DOCUMENTS 4,669,802 A 6/1987 Schaffer
5,562,493 A 10/1996 Ferrill
7,063,547 B2 * 6/2006 Toyoda et al. ..... 439/157
7,258,557 B2 * 8/2007 Matsubara et al. ..... 439/157
2003/0109166 A1 * 6/2003 Ookura ..... 439/372
2006/0154511 A1 * 7/2006 Okura ..... 439/372

FOREIGN PATENT DOCUMENTS

DE 694 16 889 T2 3/1999

* cited by examiner

*Primary Examiner*—Gary F. Paumen
(74) *Attorney, Agent, or Firm*—Lawrence E. Laubscher, Sr.; Lawrence E. Laubscher, Jr.

(57) ABSTRACT

An electrical connector assembly includes a quick-fastening locking arrangement for locking together a plug member and a socket member, including a locking peg connected with one of the plug and socket members, and a cylindrical locking cam connected with the other member, which locking cam is pivotable through a relatively small angle between locked and unlocked positions relative to the locking peg. The cylindrical locking cam is mounted at one end of the plug member adjacent the socket member for rotation about a transverse axis relative to the collinear axis of the plug and socket members. In one embodiment, the socket member is mounted in an opening contained in a mounting wall to which the locking peg is fastened. In a second embodiment, the locking peg is fastened directly to the socket member.

16 Claims, 7 Drawing Sheets

CONNECTOR SYSTEM FOR A WALL INSTALLATION

BACKGROUND OF THE INVENTION

1. Field of the Invention

An electrical connector assembly includes a quick-fastening locking arrangement for locking together a plug member and a socket member, including a locking peg connected with one of the plug and socket members, and a locking cam connected with the other member, which locking cam is pivotable through a relatively small angle between locked and unlocked positions relative to the locking peg. The locking cam is mounted at one end of the plug member adjacent the socket member for rotation about a transverse axis relative to the collinear axis of the plug and socket members.

2. Description of Related Art

Typical plug connector systems for mounting upon an opening or a breach in a mounting wall are known as such. Usually, one plug connector part—for instance, a socket part or a printed circuit board plug connector—is pre-mounted in the opening, for example, it is locked there. Then the plug connector parts are coupled together.

It is also known that one of the plug connector parts comprises a 1-piece or multipart mounting and/or electrically-shielding sheet metal piece, which secures the plug connector part upon the housing wall and possibly, for shielding purposes, contacts the then possibly metallic housing wall. For this purpose, it is normally connected with the housing wall by rotatably-operable screw thread locking means, something that is unavoidably time consuming.

Securing the plug connector parts among each other is also known. For this purpose, the plug connector parts for instance are screwed together with each other, something that is time-consuming.

The present invention was developed to provide a plug connector system of the typical kind that will ensure fast and simple mounting on a mounting wall and/or of the plug connector parts among each other.

SUMMARY OF THE INVENTION

Accordingly, a primary object of the present invention is to provide a connector assembly including quick-fastening locking means for locking together a pair of plug and socket components when in the engaged connected condition, characterized in that the locking means includes a locking peg connected with the socket member, and a cylindrical locking cam connected with the adjacent end of the plug member for pivotal movement about an axis of rotation transverse to the collinear axis of the plug and socket members.

According to a first embodiment of the invention, the socket member is mounted in an opening contained in a mounting wall, and the peg member is fastened at one end with the mounting wall adjacent the wall opening. In a second embodiment, the locking peg is fastened directly to the socket member. In both cases, the locking peg extends towards the plug member and terminates in enlarged head portion contained within locking slot means defined within the locking cam.

A more specific object of the invention is to provide a plug and socket connector arrangement in which the plug member is supported within a plug housing formed of sheet material having bottom, side, and rear end walls that define a chamber receiving the plug member. The chamber walls are lined with a liner body formed from an electrically-insulating synthetic plastic material. At one end adjacent the socket member, the liner body contains an open-topped channel that rotatably supports the cylindrical locking cam for pivotal movement between locked and unlocked positions relative to the locking peg that extends form the mounting wall to which the socket member is fastened. A first overhang portion on the plug body extends partially over the cylindrical locking cam, and a second overhang portion extends over the locking cam from either the rear wall of the liner body or from the mounting wall, thereby to retain the locking cam in the support channel.

The plug connector system of the present invention facilitates fast, simple, and low-cost attachment upon a housing wall. All that is necessary is to fashion or attach a receiving peg upon the mounting wall (for example, by riveting or screwing or in some other way). Then the locking cam is preferably is put on with the mounting sheet metal piece and the latter (or some other structural part of the plug connector part) is braced upon the housing wall in a rotary manner. There is no longer any need for expensive multiple screwing action. Besides, the locking cam can be so aligned that tool actuation will be possible not normal to the mounting wall, but essentially parallel to the latter.

If the plug connector part is made in several parts, then the locking cam is preferably inserted into the plug connector part during the assembly of the plug parts. The structural parts of the plug connector part, that is made as a multi-part assembly, can preferably be locked into each other by means of catch-dogs and corresponding catch grooves, something that facilitates fast and easily handled assembly as well as disassembly of the plug connector part.

In this manner, the mounting function can be accomplished in a simple and fast fashion. The mounting and/or screening sheet metal piece can be used only for mounting and securing the pertinent plug connector part or it can also be used for screening. These functions can be assumed alternatively also by two sheet metal pieces.

Besides, the locking cam facilitates fast, simple, and cheap securing of two plug connector parts of the plug connector system. All that is necessary is to fashion or attach at least one locking peg upon one of the plug connector parts (for example, by riveting or screwing together or in some other way). Then the mounting cam is installed and the two plug connector parts are locked together with a slight pivotal fashion. There is therefore no longer any need for any expensive multiple-turn screwing action.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
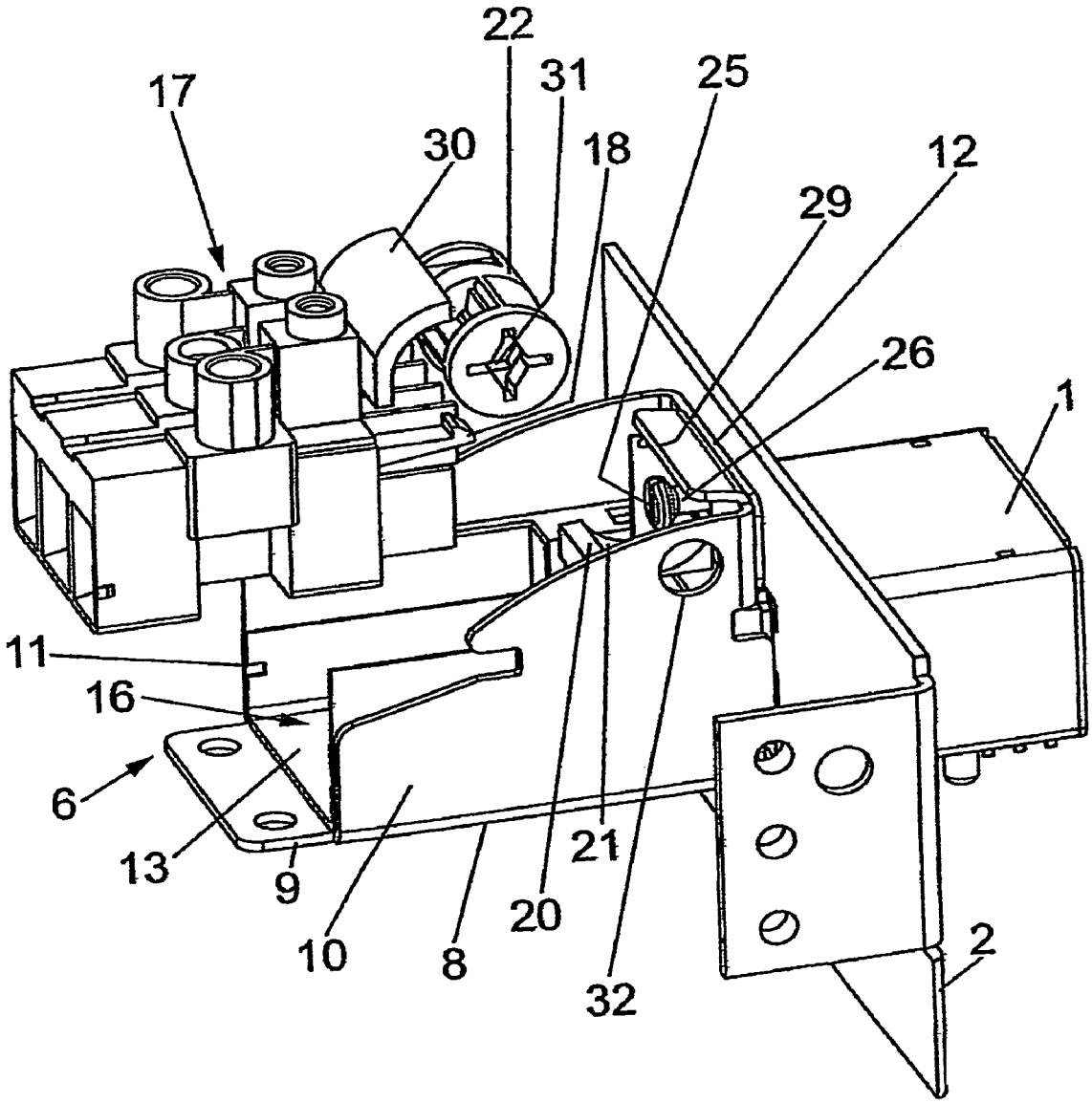
FIG. 1 is an exploded perspective front view of the connector arrangement of a first embodiment of the present invention including a mounting wall.
Figure 2:
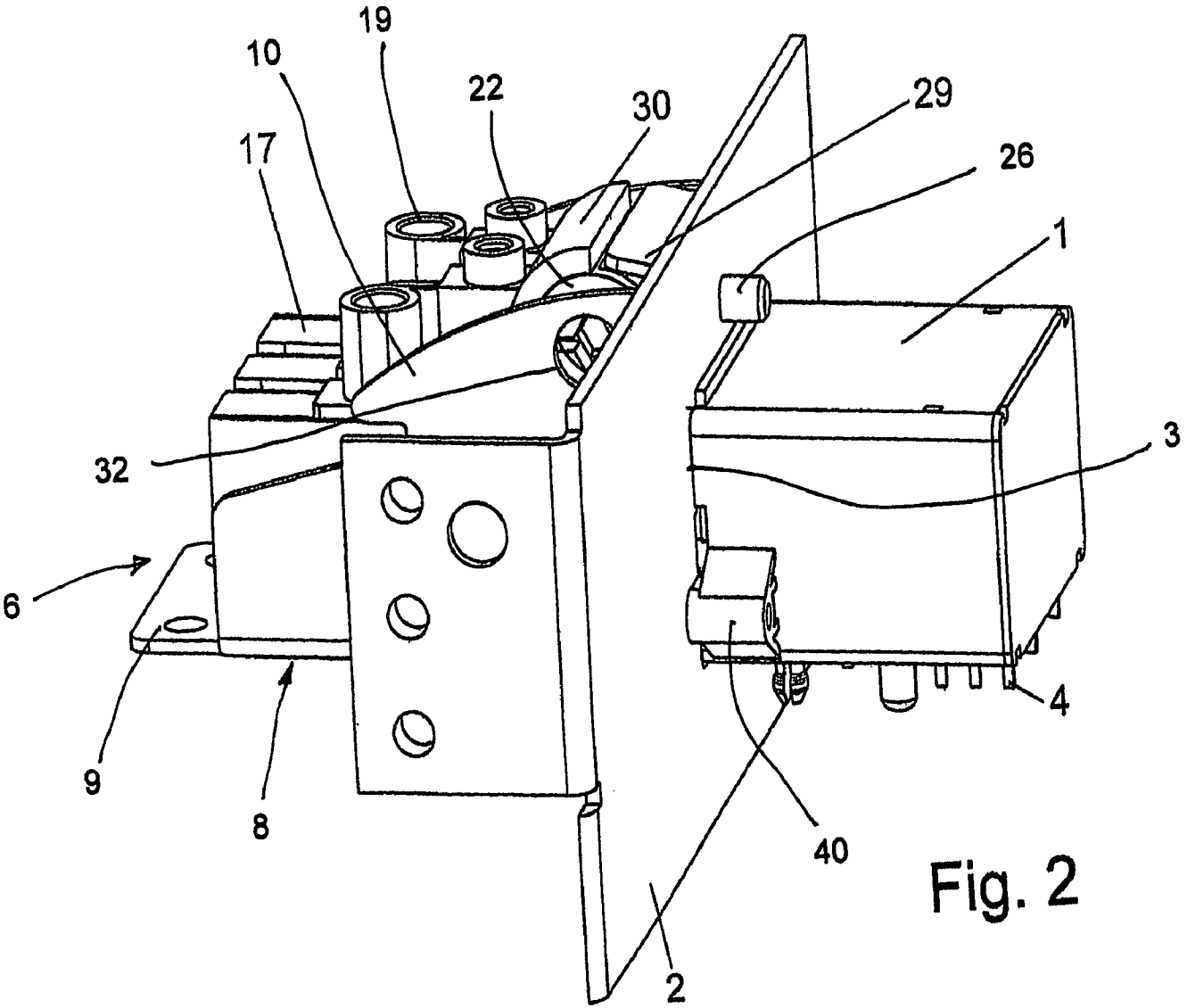
FIG. 2 is a perspective rear view of the apparatus of FIG. 1 when in the assembled condition.

Referring first more particularly to FIGS. 1 and 2, the connector apparatus of the present invention includes a plug assembly 6 that is adapted for electrical connection with a socket 1 that is mounted in an opening 3 contained in a mounting wall 2. As shown in FIG. 2, the socket 1 is fastened to the rear surface of the vertical mounting wall 2 by fastening means 40. As will be described in greater detail below, the socket means 6 is locked to the front side of the vertical mounting wall 2 by locking means including a stationary locking peg 26 that is secured to the mounting wall 2 above the wall opening 3, and a cylindrical locking cam 22 that is rotatably supported at one end of the plug means 6 for pivotal movement about an axis parallel with the mounting wall 2, and transverse to the collinear axis of the socket 1 and the plug means 6.

Figure 5A:
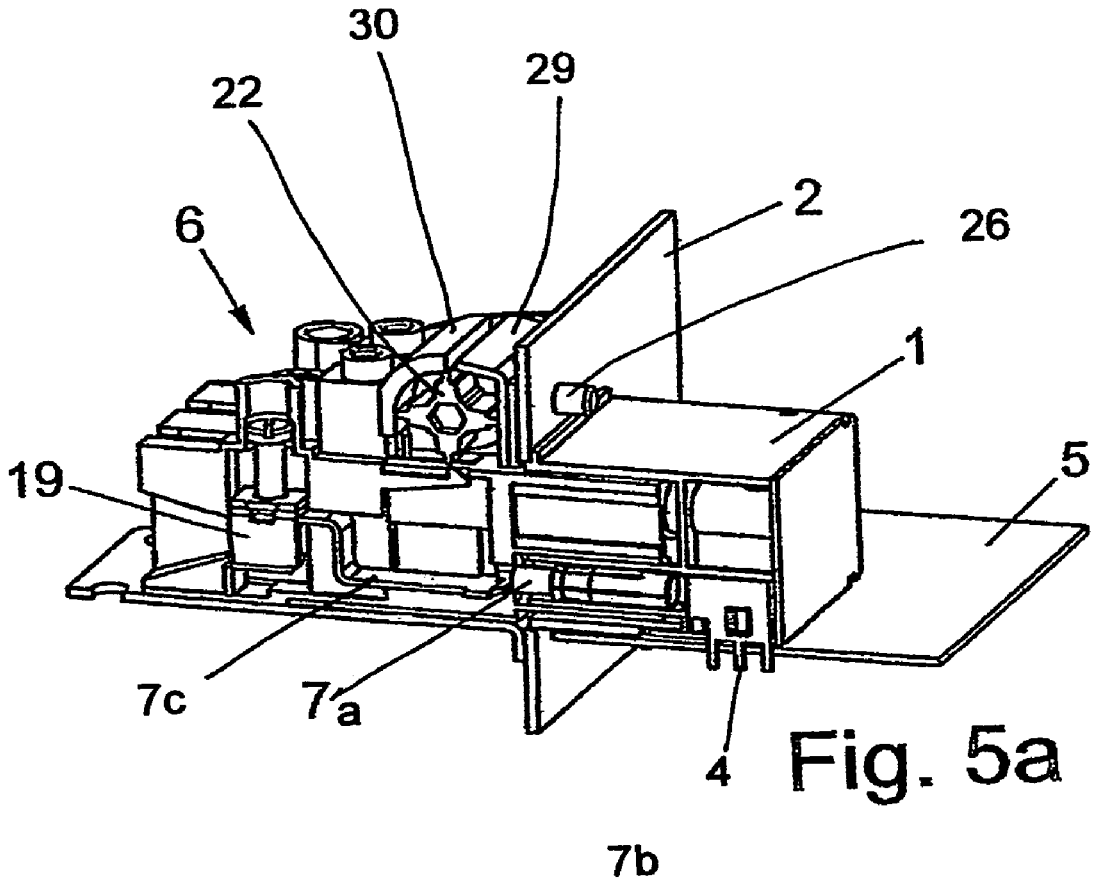
FIG. 5*a* is a sectional view illustrating the apparatus of FIG. 4 connected with a printed circuit board.

The plug means 6 includes a sheet-material housing 8 having a horizontal bottom wall 9, a pair of vertical side walls 10 and 11, and a rear wall 12 adjacent the front face of the mounting wall 2. The bottom, side and rear walls of the plug housing 8 define a chamber 16 that is lined with an insulating body 13, which chamber is adapted to receive the plug body 17 that is formed from an electrically insulating synthetic plastic material. The housing 8 may be formed of metal to electrically shield the plug means 6, or it may be formed from a synthetic plastic sheet material. The insulating liner body 13 is formed from an electrically-insulating synthetic plastic material. This liner body 13 is provided at its end adjacent the mounting wall 2 with an enlarged platform portion 20 that projects upwardly and contains at its upper surface a semi-circular channel 21 for rotatably supporting the cylindrical locking cam 22. When the plug body 17 is inserted within the chamber 16 defined within the plug housing means 8 and the liner body 13, plug contacts 7*a* (FIG. 5*a*) extend through openings 42 contained in the ends of the liner projecting body portion 20 and openings in the housing rear wall 12 for engagement with corresponding socket contacts 7*b* carried by the socket member 10. A first overhand portion 30 extends from the plug body portion 17 above the cylindrical locking cam 22. This overhang 30 cooperates with a second overhang portion 29 formed on the rear wall of the plug housing 8 to extend over the cylindrical locking cam 22, thereby to retain the locking cam in its supported position on the support channel 21.

The locking plug 26 has a shank portion that is rigidly fastened to the wall 2 by screw thread means, by rivet mean, or by welding, for example, which shank portion extends from the wall 2 in the direction of the plug body 17 and terminates in an enlarged head portion 25.

Figure 6:
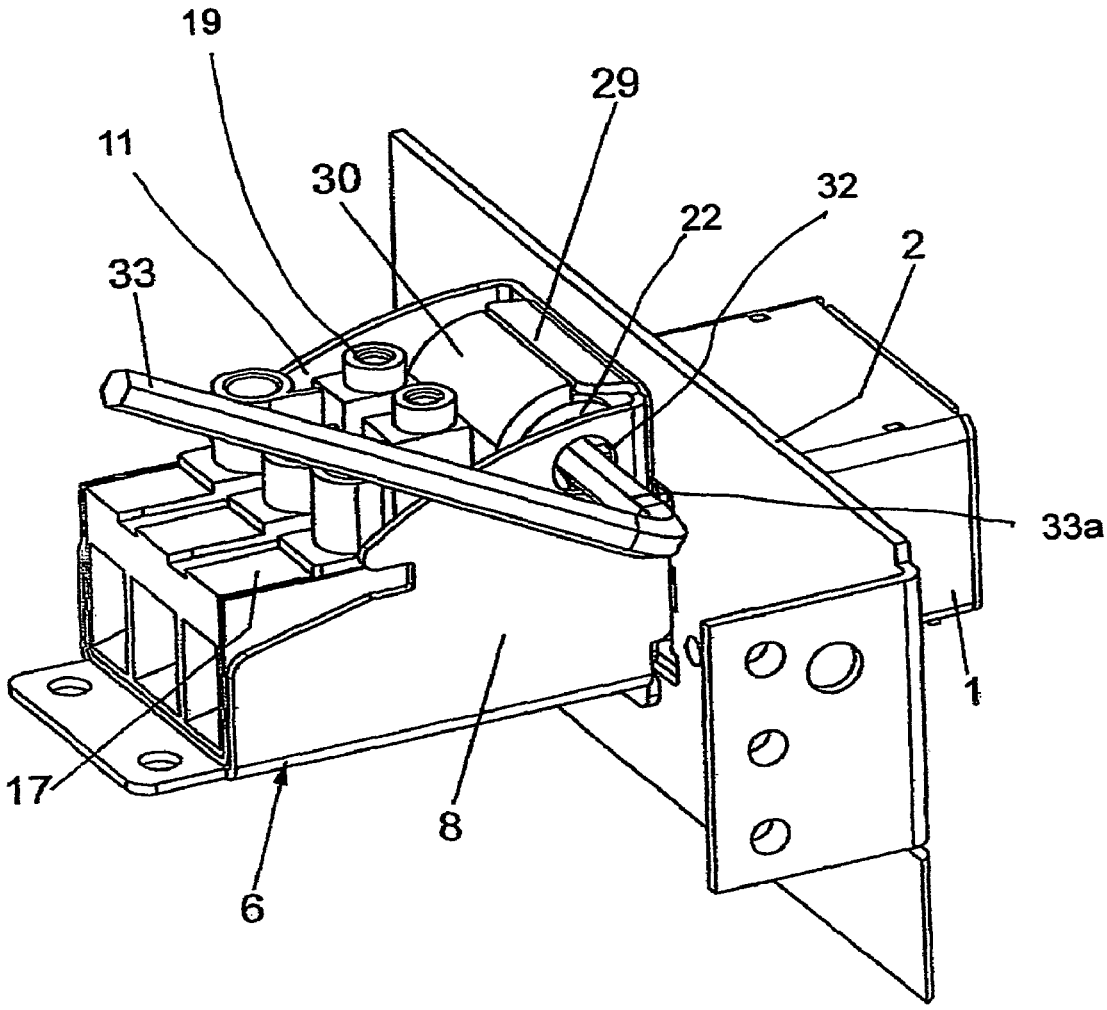
FIG. 6 is a perspective front view illustrating the manner of locking and unlocking the apparatus of FIG. 2.
Figure 7A:
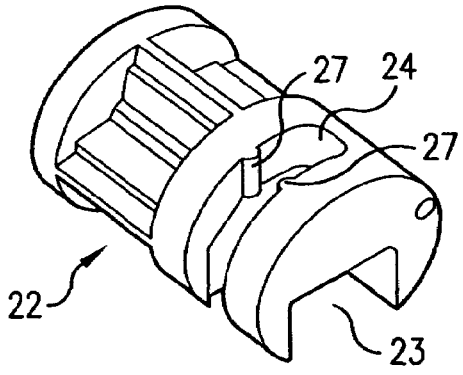
FIG. 7*a* is a front perspective view of the cylindrical locking cam.
Figure 7B:
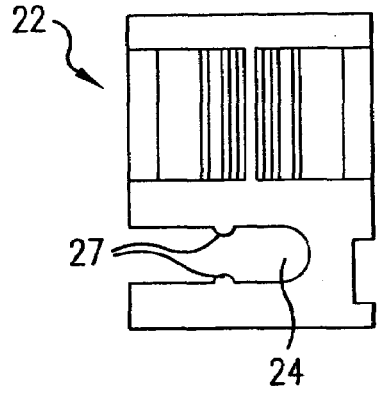
FIGS. 7*b*, 7*c* and 7*d* are top, bottom and end views, respectively, of the locking cam.
Figure 7C:
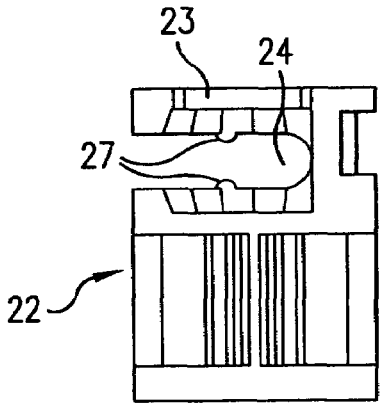
Figure 7D:
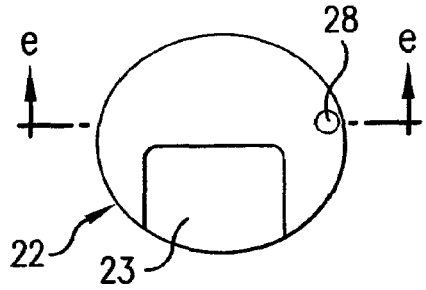

As best shown in FIG. 7*a*, the cylindrical locking cam 22 contains at one end a longitudinal slot 23 that receives the enlarge head portion 25 of the locking pin 26. The cylindrical cam member 22 is rotatable about its axis parallel with the mounting wall 2 through a relatively small acute angle between an unlocked position in which the enlarged head portion 25 of the locking pin 26 is received in the slot 23, and a locked position in which the shank portion of the locking peg 26 extends within a circumferential through slot 24 defined in the locking cam. As best shown in FIG. 6, the locking cam 22 may be pivoted between its locked and unlocked positions by an L-shaped wrench 33 having an arm portion 33*a* provided with a Phillips-head tip that is operable to engage a corresponding non-circular recess 31 contained in the adjacent end surface of the locking cam 22.

Figure 7E:
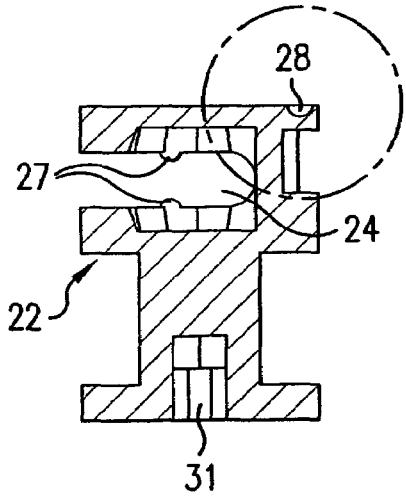
FIG. 7*e* is a longitudinal sectional view of the locking cam taken along line e-e of FIG. 7*d*.
Figure 7F:
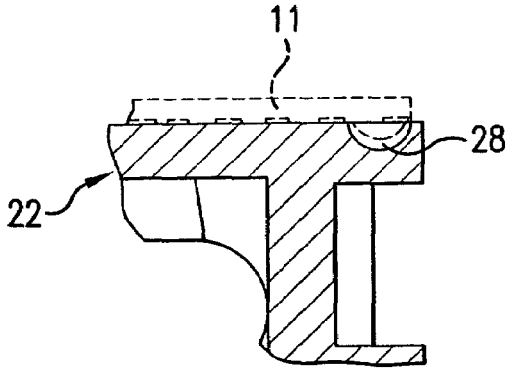
FIG. 7*f* is a detailed view of the circled portion of FIG. 7*e*.

To assemble the apparatus of FIGS. 1 and 2, the liner body 13 is inserted within the chamber 16 to line the walls of the plug housing 8, whereupon a fastening flap 14 on the housing bottom wall snaps into a corresponding fastening recess 15 contained in the liner body. The locking cam 22 is then seated upon the open-top channel 21 that is carried by the platform portion 20 of the insulated liner body 13. The plug body 17, which is formed of electrically-insulating synthetic plastic material and which carries the plug contacts 7*a* (FIG. 5*a*), is inserted into the receiving area 16 to cause locking feet 18 on the plug body 17 to snap into lock engagement with corresponding locking recesses (not shown) contained in the rear wall 12 of the housing 8. The overhang 29 extends from the upper extremity of the rear wall 12 above the locking cam, and the integral overhanging portion 30 of the plug body 17 similarly overhangs the cylindrical locking cam, thereby to retain the same in the semi-circular support channel 21. At this time, the locking peg 26, which is rigidly fastened to the mounting wall 2 above the wall opening 3, extends in the direction of the plug body 17, with the enlarged head portion 25 of the locking peg 26 being contained within the longitudinal slot 23 that is provided at one end of the cylindrical locking cam 22. The operating wrench 33 is then arranged with the arm portion 33*a* extending through the access opening 32 contained in the side wall 10 of the plug housing 8, whereupon the tool 33 is operated to pivot the locking cam about its axis from the unlocked position to the locked position. The shank portion of the locking peg 26 is now locked within the circumferential slot 24 contained in the locking cam 22. In order to retain the shank portion within the bottom of the slot 24, retaining ribs 27 (FIG. 7*a*) are provided that extend inwardly from opposite sides of the circumferential slot 24. As shown in FIG. 7*e*, detent means including a recess 28 contained in one end surface of the locking cam cooperate with a corresponding detent device mounted on the inside surface of the housing side wall 11, thereby to retain the locking cam in the locked position.

Figure 4:
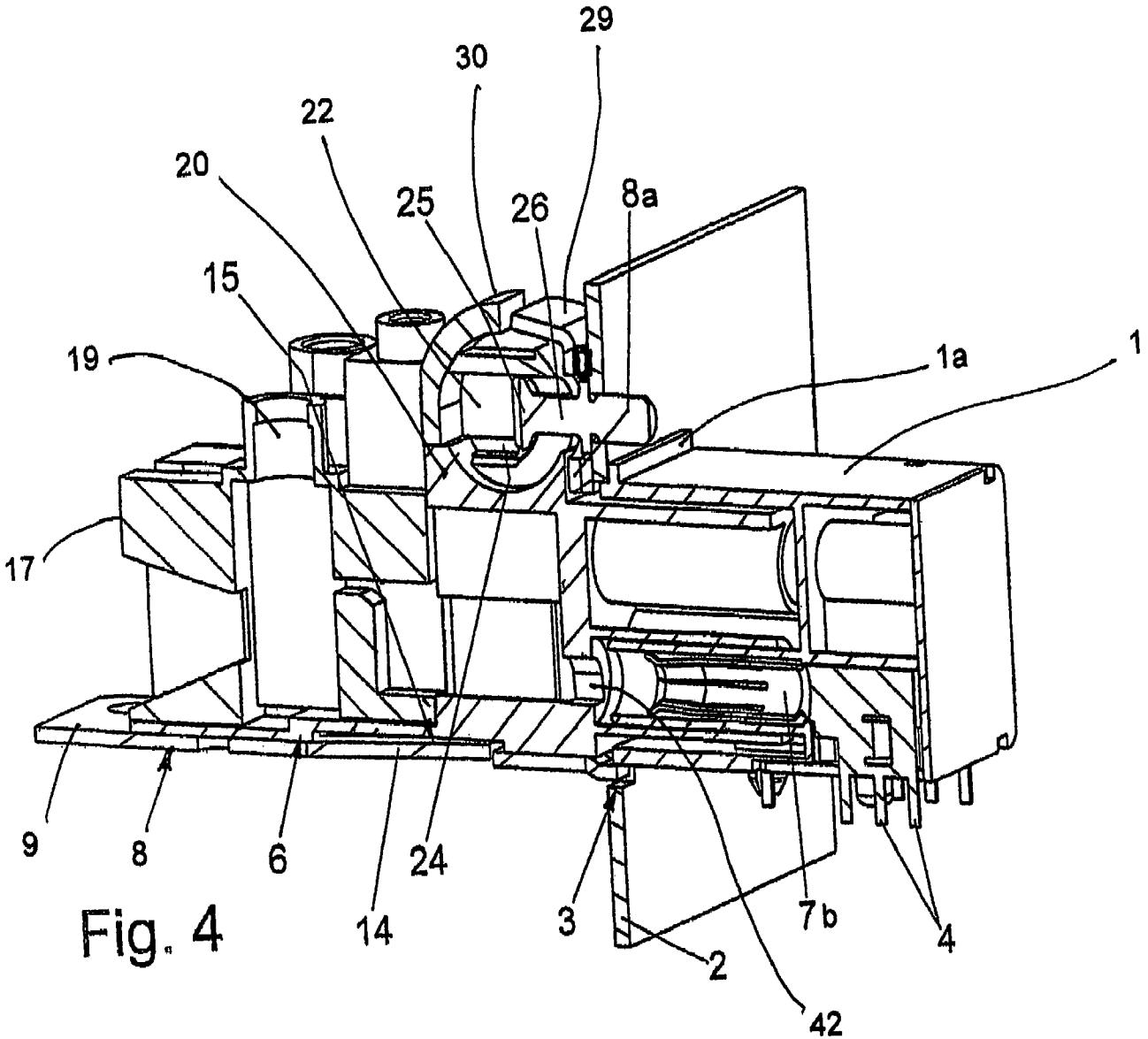
FIG. 4 is a longitudinal sectional view of the apparatus of FIG. 2.

Referring to FIG. 4, it will be seen that the pedestal end portion 20 of the liner body 13 contains an opening 42 through which the plug contacts 7*a* (FIG. 5) extend for engagement with the socket contact 7*b* contained in the socket means 1. The socket contacts 7*b* are connected with output terminals 4 that extend downwardly from the socket body 1. A support flange 1*a* on the socket 1 engages the rear surface of the vertical mounting wall 2 when the socket member is connected to the rear surface of the wall 2 by the fastening means 40. As shown in FIG. 5, the plug contact 7*a* is connected by bus bar 7*c* with output contacts 19 having screw-fastener conductor connecting means, as is known in the art. A printed circuit board 5 is be provided having circuits thereon that are engaged by the terminals 4 extending downwardly from the socket member 1.

Figure 5B:
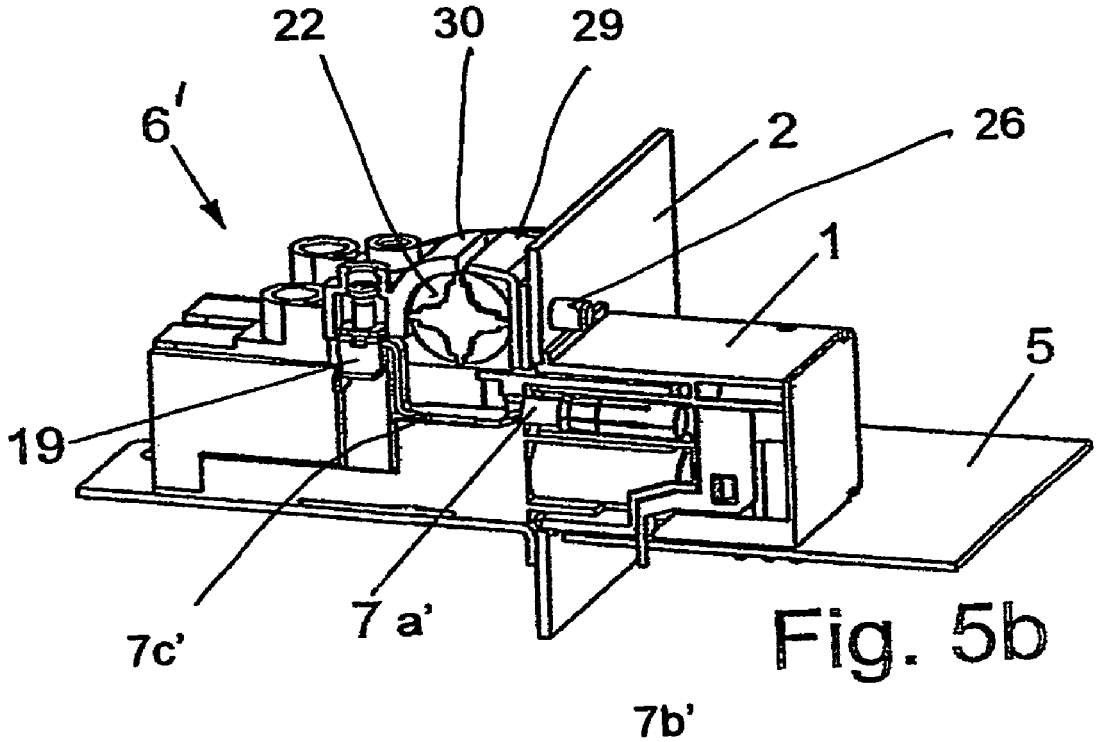
FIG. 5*b* is a corresponding view of a modified version of the apparatus of FIG. 5*a;*

Referring to FIG. 5*b*, the plug contact 7*a*' engages the socket contact 7*b*', whereby circuits on the printed circuit board 5 are connected with the plug terminals 19' via the contacts 4', the socket contacts 7*b*', the plug contacts 7*a*', the plug circuit bar 7*c*', and the output contact 19'. In both of these embodiments of FIGS. 5*a* and 5*b*, the plug means 6 and 6' are connected with the vertical wall 2 by the locking pegs 26 and the locking cams 22.

Figure 3:
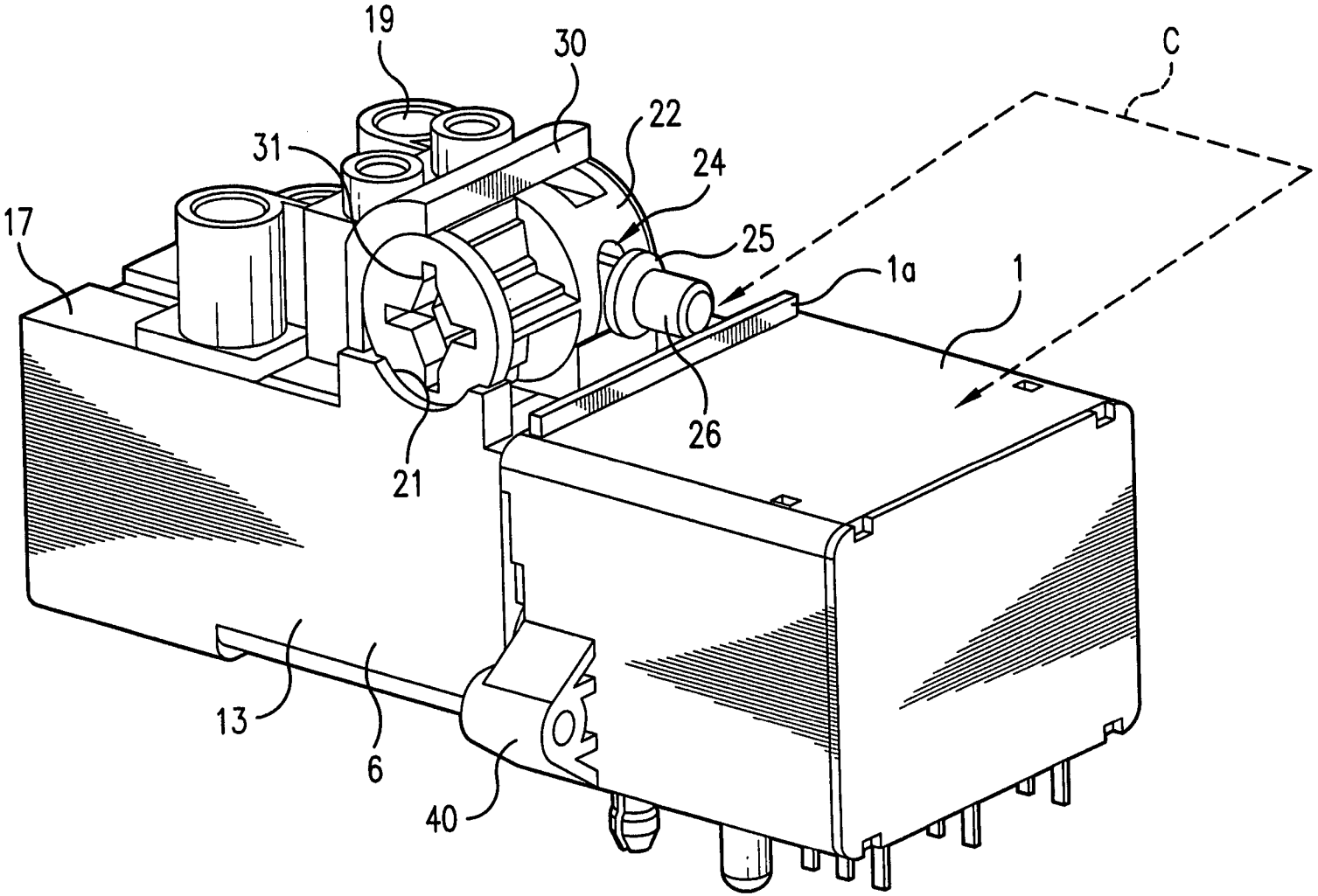
FIG. 3 is a rear perspective view of a second embodiment of the invention.

Referring to the second embodiment illustrated in FIG. 3, it will be apparent that if desired, the mounting wall 2 may be eliminated, and the plug and socket members may be directly locked together when in the engaged condition. In this case, the locking peg 26 is fastened directly to the socket 1 by connecting means C shown in phantom. As before, the locking peg 26 extends with its enlarged head portion 25 in the direction of the body 17, whereupon the locking cam 22 is pivoted to the locked position to lock the plug means 6 with the socket 1.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector assembly, comprising:

(a) plug means (6) having a plurality of plug contacts (7*a*);

(b) socket means (1) having a plurality of socket contacts (7*b*), said plug and socket means being collinearly arranged for relative longitudinal displacement between a separated disengaged position, and an adjacent position in which said plug and socket contacts are in electrical engagement, respectively; and (c) pivotally operable locking means for locking said plug and socket means in said engaged position, said locking means comprising:

(1) a stationary locking peg (26) having a first end connected with one of said plug and socket means, said locking peg having a shaft portion extending toward the other of said plug and socket means, said shaft portion terminating in an enlarged head portion (25); and (2) a cylindrical locking cam (22) connected with the other of said plug and socket means for pivotal movement about a transverse axis relative to said plug and socket means, said locking cam being pivotally displaceable between:

(a) an unlocked position in which said locking peg enlarged head portion is removably arranged relative to a first slot (23) slot contained in said locking cam; and (b) a locked position in which said enlarged head portion is locked within a second slot (24) contained in said locking cam.

2. An electrical connector assembly as defined in claim 1, and further including connecting means (C) connecting said locking pin directly with said socket means.

3. An electrical connector assembly as defined in claim 1, and further including:

(d) a mounting wall containing a wall opening (3), said plug and socket means being arranged opposite said wall opening on opposite sides of said wall, said locking peg first end portion being rigidly fastened to said wall and extending toward said plug means; and (e) fastening means (40) fastening said socket means to said mounting wall.

4. An electrical connector assembly as defined in claim 3, wherein said plug means comprises:

(1) a plug housing (8) formed from sheet material and having a horizontal bottom wall (9), a pair of vertical side walls (10, 11), and a rear wall (12), said bottom, side, and rear walls defining a chamber (16); and (2) a plug body (17) mounted in said chamber, said plug body being formed of electrically-insulating synthetic plastic material, said plug contacts being arranged at one end of said plug body and extending through an opening contained in said plug housing rear wall for engagement with said socket contacts, respectively.

5. An electrical connector assembly as defined in claim 4, wherein said plug means further includes a liner body (13) formed of electrically insulating material arranged between said plug body and said plug housing, thereby to line said chamber.

6. An electrical connector assembly as defined in claim 5, wherein said plug housing is formed of an electrically shielding metal material.

7. An electrical connector assembly as defined in claim 5, wherein said liner body includes an enlarged end portion (20) adjacent said plug housing rear wall, said end portion containing an open-topped support channel (21) rotatably supporting said locking cam for pivotal movement between said unlocked and said locked positions, respectively; and further wherein said locking peg extends from said mounting wall through an opening contained in said plug housing real wall, and with said locking peg enlarged end portion being adjacent said locking cam.

8. An electrical connector assembly as defined in claim 7, wherein said plug body includes a first overhang portion (30) that extends partially over said locking cam, thereby to at least partially retain the same in said support channel.

9. An electrical connector assembly as defined in claim 8, wherein said plug housing rear wall includes a second overhang portion (29) for retaining said locking cam in said support channel.

10. An electrical connector assembly as defined in claim 8, wherein said mounting wall includes a second overhang portion for retaining said locking cam in said support channel.

11. An electrical connector assembly as defined in claim 8, wherein said locking cam contains a longitudinal slot (23) for receiving said locking peg enlarged head portion when said locking cam is in said unlocked position; said locking cam containing a transverse circumferentially-extending slot (24) for receiving said locking peg shank portion when said locking cam enlarged head portion is contained in said longitudinal slot and said locking cam is pivoted toward said locked position.

12. An electrical connector assembly as defined in claim 11, wherein said locking cam includes rib projections (27) that extend into said transverse slot to retain said shank portion within said transverse slot.

13. An electrical connector assembly as defined in claim 11, wherein said locking cam includes an end surface containing a non-circular recess (31) for receiving the tip on an operating tool for pivoting said locking cam between said locked and unlocked positions.

14. An electrical connector assembly as defined in claim 13, wherein one of said plug housing side walls contains an access opening (32) opposite said non-circular recess.

15. An electrical connector assembly as defined in claim 14, and further including detent means (28) for retaining said locking cam in said locked position.

16. An electrical connector assembly as defined in claim 2, and further including snap fastener means (18) for releasably connecting said plug member with said plug housing.

* * * * *